United States Patent [19]

Cho et al.

[11] 4,275,330

[45] Jun. 23, 1981

[54] ELECTRIC DISCHARGE LAMP HAVING A CATHODE WITH CESIUM METAL OXIDE

[75] Inventors: Chong I. Cho, Mayfield Heights; Edward C. Zukowski, Mentor; Dimitri M. Speros, Painesville, all of Ohio

[73] Assignee: General Electric Company, Schenectady, N.Y.

[21] Appl. No.: 18,570

[22] Filed: Mar. 8, 1979

[51] Int. Cl.[3] ..... H01J 1/14; H01J 61/06

[52] U.S. Cl. ..... 313/218; 313/346 R

[58] Field of Search ..... 313/218, 346

[56] References Cited

U.S. PATENT DOCUMENTS

| | | | |
|---|---|---|---|
| 2,871,196 | 1/1959 | Speros | 252/512 |
| 2,957,231 | 10/1960 | Davis et al. | 29/182.5 |
| 3,283,195 | 11/1966 | Hall et al. | 313/218 X |
| 3,467,878 | 9/1969 | Newberry | 313/218 X |
| 3,708,710 | 1/1973 | Smyser et al. | 313/213 |
| 3,758,184 | 9/1973 | Menzel | 313/218 X |
| 3,758,809 | 9/1973 | Menelly et al. | 313/346 |
| 3,798,492 | 3/1974 | Menelly | 313/346 |
| 3,906,271 | 9/1975 | Aptt, Jr. | 313/346 |
| 4,097,762 | 6/1978 | Hilton et al. | 313/218 |
| 4,152,620 | 5/1979 | Bhalla | 313/218 |

*Primary Examiner*—Palmer C. Demeo

*Attorney, Agent, or Firm*—John F. McDevitt; Lawrence R. Kempton; Philip L. Schlamp

[57] ABSTRACT

A discharge type electric lamp construction is described having electrode means which include a porous sintered body of refractory metal having an electron emissive material containing cesium ion dispersed in the pores of said porous sintered body as $Cs_2MO_4$ wherein M is a refractory metal. Said electron emissive material is preferably employed in combination with another electron emissive material containing barium ions to provide a lower breakdown voltage as well as operating voltage characteristics for said discharge lamps. Representative electron emissive materials containing barium ions include barium aluminate and barium tungstate materials.

9 Claims, 1 Drawing Figure

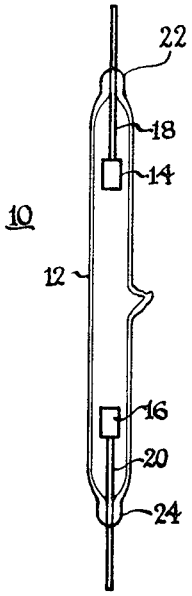
22
18
14
10
12
16
20
24

ELECTRIC DISCHARGE LAMP HAVING A CATHODE WITH CESIUM METAL OXIDE

BACKGROUND OF THE INVENTION

The use of barium aluminate material in the electron emission means of discharge electric lamps is disclosed in U.S. Pat. Nos. 2,871,196 and 2,957,231, both of which patents being assigned to the assignee of the present invention. As therein disclosed, said electron emissive material can be dispersed in the pores of a sintered refractory metal such as a sintered tungsten pellet by impregnation for use as an electrode member in a photographic flash tube type gaseous electric discharge lamp. The breakdown or starting voltage of said barium aluminate electron emissive material is said to exceed 250 volts depending upon the particular type lamp construction, and higher voltage operation is also said to be possible with the disclosed electron emission means. Use of barium tungstate compounds as emission material having similar voltage operating characteristics in sodium vapor type discharge lamps is disclosed in U.S. Pat. No. 3,708,710, also assigned to the present assignee. The described lamps further include a filling of sodium along with a rare gas such as xenon to facilitate starting along with mercury for improved efficiency. The particular electron emissive material therein disclosed is said to be a good emitter and at the same time more resistant to vaporization in ion bombardment when used in this type lamp than emission materials previously available.

While both of the foregoing barium aluminate and barium tungstate emission materials exhibit long term stability of operation during lamp life, it would be understandably beneficial from an energy efficiency and cost standpoint to operate at lower voltage requirements. Thus, lower breakdown voltage and operating voltage characteristics for the electron emission means of an electric discharge lamp represents a desirable improvement especially if these lower voltage requirements can be obtained without sacrificing other desirable characteristics during lamp operation.

SUMMARY OF THE INVENTION

It has now been discovered, surprisingly, that a novel electron emission means for an electric discharge lamp of the general type above described provides lower voltage breakdown and operating voltage characteristics in a stable manner during the entire lamp lifetime. Specifically, said novel electron emission means comprises a porous sintered body of refractory metal having an electron emission material containing $Cs_2MO_4$ dispersed in the pores of said porous sintered body wherein M is a refractory metal. As used herein, the term "refractory metal" represents a heavy metal transition element in Group IV, V, and VI of the Periodic Table such as zirconium, tungsten, tantalum and molybdenum, to include the alloys of said heavy metal transition element already known to provide suitable electron emission in an electric discharge lamp environment. While the exact mechanism for such stabilized lowering of the voltage breakdown and operating voltage characteristics of the present electron emission means is not known at this time, it is believed attributable to having the above-identified interoxide chemically react with the heavy metal transition element constituent of the electrode body member to form a lower work function product. For example, the incorporation of $Cs_2MoO_4$ as the interoxide in the pores of a sintered body of molybdenum is believed to permit a chemical reaction to take place during lamp operation as follows:

$$2\ Cs_2MoO_4 + \tfrac{1}{2}Mo \rightarrow Cs_2Mo_2O_7 + 2\ Cs + \tfrac{1}{2}MoO_2$$

The product in the aforesaid chemical reaction is a low work function combination of $MoO_2$ and cesium ion with the continuous nature of said chemical reaction during lamp operation further permitting replacement of any volatilized cesium ion from said lower work function combination.

In its preferred embodiments, the improved electron emission means comprises a porous sintered body of refractory metal having a first electron emissive material containing barium ions dispersed in the pores of said porous sintered body together with a second electron emissive material of the above identified interoxide. The barium ion containing emissive material can be selected from the barium aluminate and barium tungstate materials previously used in electric discharge lamps and the combination therewith of said cesium containing interoxide by conventional doping means produces a cathode member for a flash tube type discharge lamp operating at dramatically lower voltage requirements and higher light output as hereinafter explained in greater detail.

In view of the foregoing, it is therefore the primary object of the present invention to provide improved electron emission means for an electric discharge lamp in the form of a cathode member comprising a porous sintered body refractory metal having a electron emissive material containing $Cs_2MO_4$ dispersed in the pores of said porous sintered body and wherein M is a refractory metal.

Another important object of the invention is to provide a cathode member comprising a porous sintered body refractory metal having a first electron emissive material containing barium ions dispersed through the pores of said porous sintered body together with a second electron emissive material of $Cs_2MO_4$ wherein M is a refractory metal.

Still other important objects and advantages of the present invention will be apparent from the hereinafter provided detailed description which includes a flash tube type discharge lamp configuration utilizing the present electron emission means.

BRIEF DESCRIPTION OF THE DRAWING

The accompanying drawing depicts in cross section a flash tube type lamp having a cathode member in accordance with the present invention.

DETAILED DESCRIPTION OF THE PRESENT INVENTION

According to the accompanying FIGURE, there is shown a cross section of a conventional flash tube type lamp construction 10 having a transparent envelope 12 which contains a pair of spaced apart discharge electrodes 14 and 16 hermetically sealed by conventional means within said envelope and an ionizable atmosphere (not shown) within said envelope. As can be further noted from said drawing, the transparent envelope 12 can be a tubular glass construction having electrode members sealed at each end of the tube. Xenon or some other ionizable gas provides the ionizing atmosphere for said lamp construction. Electrodes 14 and 16 provide the anode and cathode elements of said lamp construction and can be in the form of pressed sintered pellets of tantalum or some other suitable refractory metal such as tungsten which are attached to a pair of lead-in wires 18 and 20, respectively, for hermetically sealing of said lead-in wires at ends 22 and 24 of the lamp envelope in a conventional manner. It is also conventional in such type lamps to provide starting electrode means (not shown) in the form of a transparent conducting coating on the exterior surface of the glass tube and which is electrically connected to a source of high frequency high voltage current (also not shown) by conventional terminal means.

As a specific example for construction of a cathode member according to the present invention, 95 parts of finely divided tantalum powder is mixed with 5 parts $Ba_2CaWO_6$ emission powder and the mixture blended for an hour in a glass jar. One part of a suitable organic lubricant is added to the blended mixture for mechanical pressing of the electrode pellet in a conventional manner. The pressed electrode pellet is thereafter heated to approximately 600° for evaporation of the organic lubricant and the pellet is thereafter vacuum fired at approximately 1550° C. to provide a suitable pore structure for impregnation with a $Cs_2MoO_4$ emission material of the present invention.

Said emission material dopant is prepared as a liquid suspension of 5 parts emission material in 90 parts ethanol and 5 parts distilled water. The electrode pellets are immersed in said liquid solution and the soaked pellets thereafter are placed in a vacuum dessicator until all liquid has been evaporated. The doped electrode pellets are thereafter dried at approximately 120° C. under a nitrogen atmosphere to provide the electrode members in the above described lamp construction.

Test lamps having said above described configuration were constructed for comparison in the lamp performance between electrodes utilizing only the $Ba_2CaWO_6$ emission material and electrodes utilizing said emission material which further had been doped with $Cs_2MoO_4$. One series of lamps employed a glass tube envelope with dimensions of 5 millimeters inside diameter and 7 millimeters outside diameter, a 37 millimeter gap spacing between the two electrodes and a 125 torr pressure fill of xenon gas. A smaller series of lamps was also tested utilizing a glass tube envelope with a 2.5 millimeter inside diameter and 3.8 millimeter outside diameter, a 20 millimeter gap spacing of the electrodes, and a 520 torr pressure fill of xenon. Whereas the larger size lamp series exhibited 275 volts breakdown voltage at a 4.5 Kv triggering voltage pulse and 200 volts breakdown voltage at 9.0 Kv triggering voltage pulse for the undoped electrode lamps, the breakdown voltage was reduced to 85 volts and 68 volts breakdown voltage at the same applied triggering voltages, respectively, when the electrodes have been doped with $Cs_2MoO_4$. The test results achieved for the smaller size lamp series which utilized a 3.3 Kv triggering pulse produced an average breakdown voltage value of 207 volts for undoped electrode lamps while the doped electrode lamps exhibited a lower average 176 volts breakdown voltage. Accordingly, it follows from said test results that a substantial reduction in breakdown voltage is gained in accordance with the present invention.

Another series of lamp performance tests were conducted on the above identified smaller size lamps for an evaluation of the light output and voltage breakdown characteristics during continued operation of the lamps up to 1500 flashes. Accordingly, said lamps were operated at the rate of 6 flashes per minute during these further tests under conditions determined to have applied approximately 11.5 joules energy loading to the tested lamps. According to said tests, the lamps with doped electrodes all exhibited a lower breakdown voltage for the initial 1,000 flashes, but the 1500 flash voltage breakdown values were not always superior in this regard. On the other hand, some of the HCPS light output values obtained during said further tests were found superior for the undoped lamps during the initial 250 flashes although the HCPS light output values for the doped electrodes proved uniformly superior thereafter during the remaining 1500 flashes. Said further test results thereby serve to indicate a general improvement attributable to practice of the present invention.

From all of the foregoing results, it will be apparent to those skilled in the art that various modifications may be made within the scope of the present invention. For example, other electric lamp configurations than the flash tube construction above specifically disclosed can benefit by incorporation of the presently improved electron emissive material. It will also be evident that modifications in the compositions of said electron emissive material as well as the composition of the sintered body of refractory metal can also be made to still provide a desired reduction in the voltage operating characteristics of a discharge lamp and which may be further accompanied by an increase in the lamp light output. It is intended to limit the present invention, therefore, only by the scope of the following claims.

What we claim as new and desire to secure by Letters Patent of the United States is:

1. A cathode comprising a porous sintered body of refractory metal and a first electron emissive material selected from barium aluminate and barium tungstate, said cathode having $Cs_2MO_4$ as a second electron emissive material dispersed in the pores of said porous sintered body and wherein M is a refractory metal.

2. A cathode as in claim 1 wherein the refractory metal of said porous sintered body is tungsten.

3. A cathode as in claim 1 wherein M is tantalum.

4. An electric discharge lamp comprising a transparent envelope containing a pair of spaced apart discharge electrodes hermetically sealed within said envelope and an ionizable atmosphere within said envelope, at least one of said electrodes comprising a porous sintered body of refractory metal and a first electron emissive material selected from barium aluminate and barium tungstate, said cathode having $Cs_2MO_4$ as a second electron emissive material dispersed in the pores of said porous sintered body and wherein M is a refractory metal.

5. An electric discharge lamp as in claim 4 wherein the transparent envelope is a glass tube and the electrodes are sealed at each end of said glass tube.

6. An electric discharge lamp as in claim 5 wherein both electrodes are the same.

7. An electric discharge lamp as in claim 5 wherein the refractory metal of said porous sintered body is tungsten.

8. An electric discharge lamp as in claim 4 wherein M is tantalum.

9. A photographic flash tube having the lamp configuration of claim 4 and wherein the ionizable atmosphere is xenon gas.

* * * * *